US010888162B1

(12) United States Patent
McLennan

(10) Patent No.: US 10,888,162 B1
(45) Date of Patent: Jan. 12, 2021

(54) THEATER RECLINER ASSEMBLY AND METHOD FOR MOUNTING RECLINERS TO EXISTING THEATER RISERS

(71) Applicant: Daryn Eugene McLennan, Ashland, OR (US)

(72) Inventor: Daryn Eugene McLennan, Ashland, OR (US)

( * ) Notice: Subject to any disclaimer, the term of this patent is extended or adjusted under 35 U.S.C. 154(b) by 64 days.

(21) Appl. No.: 16/431,604

(22) Filed: Jun. 4, 2019

Related U.S. Application Data

(60) Provisional application No. 62/680,945, filed on Jun. 5, 2018.

(51) Int. Cl.

| | |
|---|---|
| ***A47C 1/034*** | (2006.01) |
| ***A63J 25/00*** | (2009.01) |
| ***A47C 1/124*** | (2006.01) |
| ***A47C 7/00*** | (2006.01) |

(52) U.S. Cl.
CPC ..... *A47C 1/0342* (2013.01); *A47C 1/124* (2013.01); *A47C 7/008* (2013.01); *A63J 25/00* (2013.01)

(58) Field of Classification Search
CPC ..... A47C 1/0342; A47C 1/24; A47C 7/008; A63J 25/00
See application file for complete search history.

(56) References Cited

U.S. PATENT DOCUMENTS

| | | | | |
|---|---|---|---|---|
| 7,000,989 | B2 * | 2/2006 | Fisher | A47C 1/121 297/335 |
| 9,370,248 | B2 * | 6/2016 | Ramirez Magana | A47C 1/024 |
| 9,730,518 | B1 * | 8/2017 | Jacobs | A47C 7/746 |
| 9,943,174 | B1 * | 4/2018 | Jacobs | H01R 24/78 |
| 2016/0302573 | A1 * | 10/2016 | Garland | A47C 1/036 |
| 2018/0316213 | A1 * | 11/2018 | Havell | A47C 31/00 |
| 2019/0387884 | A1 * | 12/2019 | Jacobs | A47C 7/622 |

* cited by examiner

*Primary Examiner* — Anthony D Barfield
(74) *Attorney, Agent, or Firm* — Davis Wright Tremaine LLP; George C. Rondeau, Jr.

(57) ABSTRACT

A theater recliner assembly and method for mounting recliners to existing theater risers provides a recliner chair that mounts directly on pre-existing theater risers, without requiring construction of new risers, and without the need for significant modification to the existing stairs and seating rows. The mounting and reclining components of the assembly are configured to form voids, have low profiles, and miniaturized sizes, so as to fit on the riser. The recliner chair comprises a pair of L-shaped bases adapted to rest flush against the riser. The recliner chair further comprises a backrest, a low profile seat cushion, an extendable footrest, and a miniaturized lifting mechanism. The miniaturized lifting mechanism fits between the seat cushion and the riser, providing a series of connected links and fulcrums that facilitate tilting between the upright and reclined positions. The low profile of the seat cushion provides operational space for the miniaturized lifting mechanism.

8 Claims, 5 Drawing Sheets

TRADITIONAL REMODEL – EXISTING STADIUM SEATING TO RECLINER SEATING

DARYN'S REMODEL – EXISTING STADIUM SEATING TO RECLINER SEATING

THEATER RECLINER ASSEMBLY AND METHOD FOR MOUNTING RECLINERS TO EXISTING THEATER RISERS

FIELD OF THE INVENTION

The present invention relates generally to a theater recliner assembly and method for mounting recliners to existing theater risers. More so, the present invention relates to a recliner chair that mounts directly on pre-existing theater risers, without requiring construction of new risers, and without the need for significant modification to the existing stairs and seating rows; whereby the recliner chair comprises a pair of L-shaped bases positioned over the edge of the stadium riser; whereby the recliner chair comprises an extendable footrest that conceals the vertical wall of the stadium riser when retracted; whereby the recliner chair comprises a seat cushion that is separated from the horizontal wall of the riser by a small distance; whereby the recliner chair comprises a lifting mechanism that is modified, e.g., displaced horizontally, or miniaturized, to fit and operate in a small space between the seat cushion and the horizontal wall (concrete floor of the top row); and whereby the recliner chair comprises a backrest that functions in the same manner of a traditional cinema recliner.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
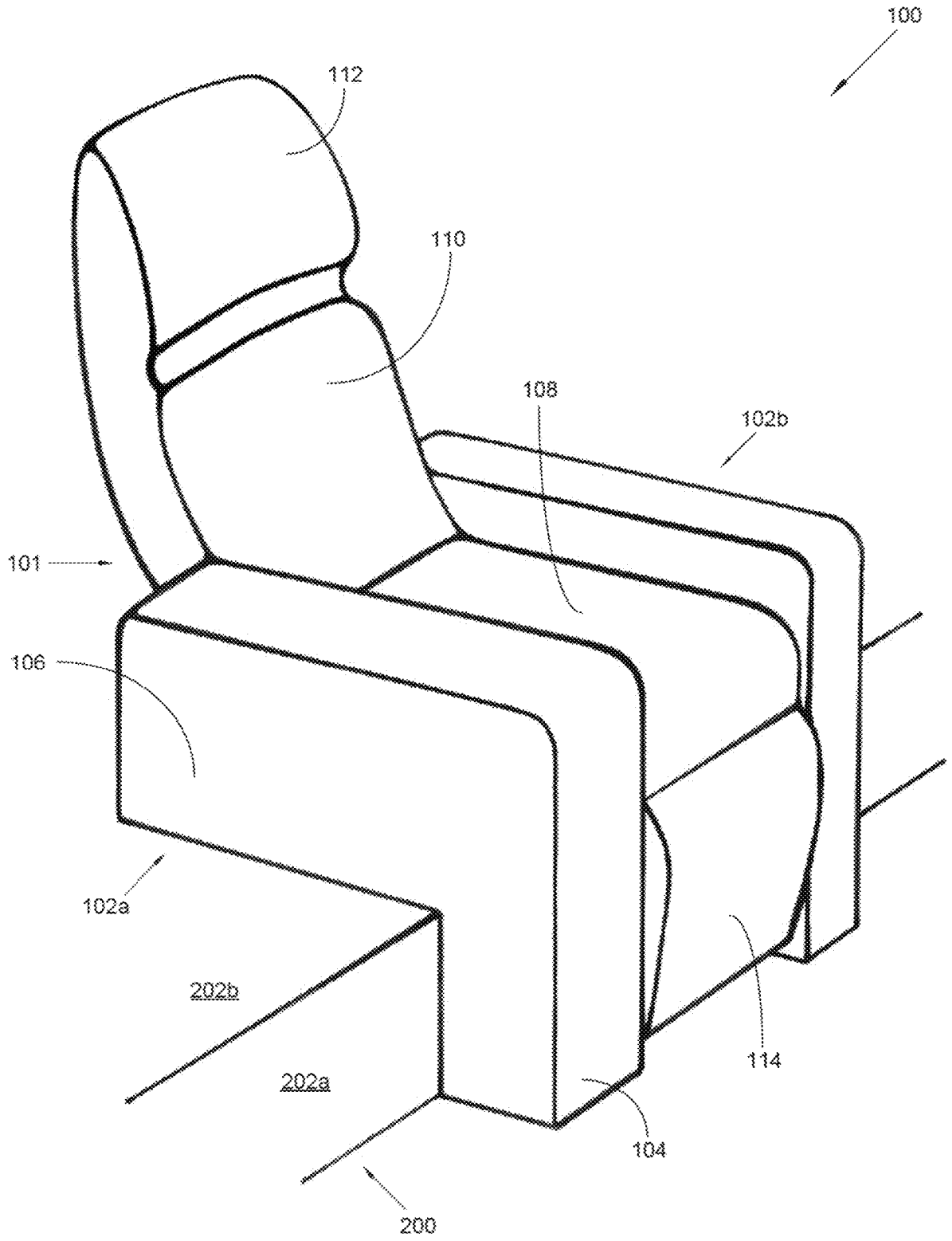
FIG. 1 illustrates a perspective view of an exemplary theater recliner assembly, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A theater recliner assembly 100 and method 300 for mounting recliners to existing theater risers is referenced in FIGS. 1-4. The theater recliner assembly 100, hereafter "assembly 100" provides a recliner chair 101 that mounts directly on pre-existing theater risers, without requiring construction of new risers, and without the need for significant modification to the existing stairs and seating rows. The mounting and reclining components of the assembly 100 are configured to form voids, have low profiles, and miniaturized sizes, so as to fit on the riser.

In some embodiments, the recliner chair 101 may include a pair of L-shaped bases 102*a*, 102*b* adapted to rest flush against the riser. The generally L-shape of the bases 102*a*, 102*b* creates a unique adaptation and void that enables modular-style mounting to a variety of risers 200, and specifically theater risers, known in the art. The recliner chair 101 further comprises a backrest 110, a low profile seat cushion 108, an extendable footrest 114, and a miniaturized lifting mechanism 116 to enable reclining articulation from directly on the riser 200.

The recliner chair 101 is configured to articulate between an upright position and a reclined position directly on the theater riser 200. In one embodiment, the recliner chair 101 reclines when an occupant extends the legs to lower the backrest 110 and raise the footrest 114. The backrest 110 can be tilted back, and the extendable footrest 114 extended by pushing back on the backrest 110, and the footrest 114 extended automatically when the backrest 110 is reclined. In one embodiment, the recliner chair 101 is motorized, so that the raising and lowering of the footrest is automated. This may also be controlled at the side of the recliner chair 101, or remotely through a remote controller.

The low profile seat cushion 108 is generally thinner than a standard seat cushion 108, so that the miniaturized lifting mechanism 116 can fit between the seat cushion 108 and the horizontal wall 202*b* of the riser 200. The miniaturized lifting mechanism 116, which is configured to fit between the seat cushion 108 and the riser 200, provides a series of connected links and fulcrums 118*a*, 118*b* that facilitate tilting between the upright and reclined positions.

In one aspect, the theater recliner assembly 100 comprises:

a recliner chair 101 having:

a pair of L-shaped bases 102*a*, 102*b* defined by a vertical member 104 and a horizontal member 106, the L-shaped bases 102*a*, 102*b* being operable to detachably mount to a riser 200 defined by a vertical wall 202*a* and a horizontal wall 202*b*, whereby the vertical member 104 of the L-shaped bases 102*a*, 102*b* rests flush against the vertical wall 202*a* of the riser 200, and the horizontal member 106 of the L-shaped bases 102*a*, 102*b* rests flush against the horizontal wall 202*b* of the riser 200;

a low profile seat cushion 108 being disposed parallel with the horizontal wall 202*b* of the riser 200;

a backrest 110 being disposed adjacent to the seat cushion 108, the backrest 110 configured to tilt rearwardly and forward in relation to the low profile seat cushion 108;

an extendable footrest 114 being disposed adjacent to the seat cushion 108, the extendable footrest 114 being operable to conceal the vertical wall 202*a*, the footrest 114 configured to extend and retract in relation to the vertical wall 202*a;* whereby the backrest 110 tilts rearwardly, and the extendable footrest 114 extends when a rearward force is applied to the backrest 110, whereby the backrest 110 tilts forward, and the extendable footrest 114 retracts when a forward force is applied to the backrest 110; and a miniaturized lifting mechanism 116 disposed between the seat cushion 108 and the horizontal wall 202*b* of the riser 200, the miniaturized lifting mechanism 116 being operatively connected to the backrest 110 and the extendable footrest 114, whereby the miniaturized lifting mechanism 116 facilitates rearward and forward tilting by the backrest 110, whereby the miniaturized lifting mechanism 116 facilitates extension and retraction of the footrest 114, whereby the low profile of the seat cushion 108 provides operational space for the miniaturized lifting mechanism 116.

In another aspect, the horizontal member 106 of the L-shaped base is longer than the vertical member 104.

In another aspect, the assembly 100 further comprises a headrest 112 disposed coplanar with the backrest 110.

In another aspect, the riser 200 is a theater riser.

In another aspect, the seat cushion 108 is padded.

In another aspect, the backrest 110 is padded.

One objective of the present invention is to mount theater recliner chairs to existing theater risers with minimal modification to the risers.

Another objective is to save 60% or more of the cost of converting an existing stadium seating auditorium to recliner seating.

Another objective is to significantly reduce the amount of time necessary to convert an auditorium from standard stadium seating to recliner seating.

Another objective is to provide a low profile seat cushion 108 that provides operational space for the miniaturized lifting mechanism 116.

Another objective is to provide a miniaturized lifting mechanism 116 that is operational in the small space between the seat cushion 108 and the horizontal wall 202*b* of the riser 200.

Another objective is to conceal the vertical wall 202*a* of the riser 200 with the footrest 114.

Another objective is to provide a theater recliner that is easy to tilt rearwardly and forward while being occupied.

Yet another objective is to minimize the need to fill in every other row in the stadium seating.

Yet another objective is to minimize the need to modify aisle lighting, hand rails, or wall coverings.

Yet another objective is to minimize the need for new carpet and flooring.

Those skilled in the art will recognize that currently, installing recliner seats into a cinema with existing stadium seating, requires that every other row in the auditorium be filled in to accommodate the installation of the new seats. This is both time consuming and expensive in terms of construction costs. The present invention enables a cinema recliner seat to be constructed to rest directly on top of existing stadium risers without requiring significant modifications to the existing construction, stairs, rows, carpeting, and wall lighting. This dramatically reduces the cost of a recliner conversion by up to 80% as well as significantly reduces the amount of time required for the conversion.

As referenced in FIG. 1, the recliner chair 101 comprises a pair of L-shaped bases 102*a*, 102*b* that detachably mount directly over the edge of a riser 200. The riser 200 may include a theater riser 200 known in the art. The riser 200 may also include a single step or double step riser 200. The riser 200 comprises a horizontal wall 202*b* (concrete floor of the top row) and a vertical wall 202*a*.

The L-shaped bases 102*a*, 102*b* provide the supportive foundation for the assembly 100 atop the riser 200. The unique L-shape of the bases 102*a*, 102*b* creates a void that enables the horizontal and vertical wall 202 of the riser 200 to fit snugly. In some embodiments, the L-shaped bases 102*a*, 102*b* comprise a horizontal member 106 that rests flush against a horizontal wall 202*b* of the riser 200*s*. The L-shaped bases 102*a*, 102*b* may further include a vertical member 104 that rests flush against a vertical wall 202*a* of the riser 200.

The horizontal and vertical members 106, 104 for a perpendicular relationship. In one non-limiting embodiment, the horizontal member 106 of the L-shaped base is longer than the vertical member 104. Further, the horizontal member 106 is sufficiently wide, and may contain depressions to retain theater-related items, such as purses, popcorn, and drink receptacles.

The chair recliner 101 further includes a low profile seat cushion 108 that is separated from the horizontal wall 202*b* of the riser 200 by a small distance, such as 6" or less. In other embodiments, the low profile seat cushion 108 is, however, separated from the horizontal wall 202*b* of the riser 200 by a distance greater than 6". This is because the recliner chair is scalable to accommodate variously sized theater risers. The low profile seat cushion 108 is disposed parallel with the horizontal wall 202*b* of the riser 200. The seat cushion 108 may be padded, so as to comfortable support the buttocks of an occupant. In one non-limiting embodiment, the seat cushion 108 comprise upholstered backs, including a sculpted foam, such as polyurethane foam.

Figure 3:
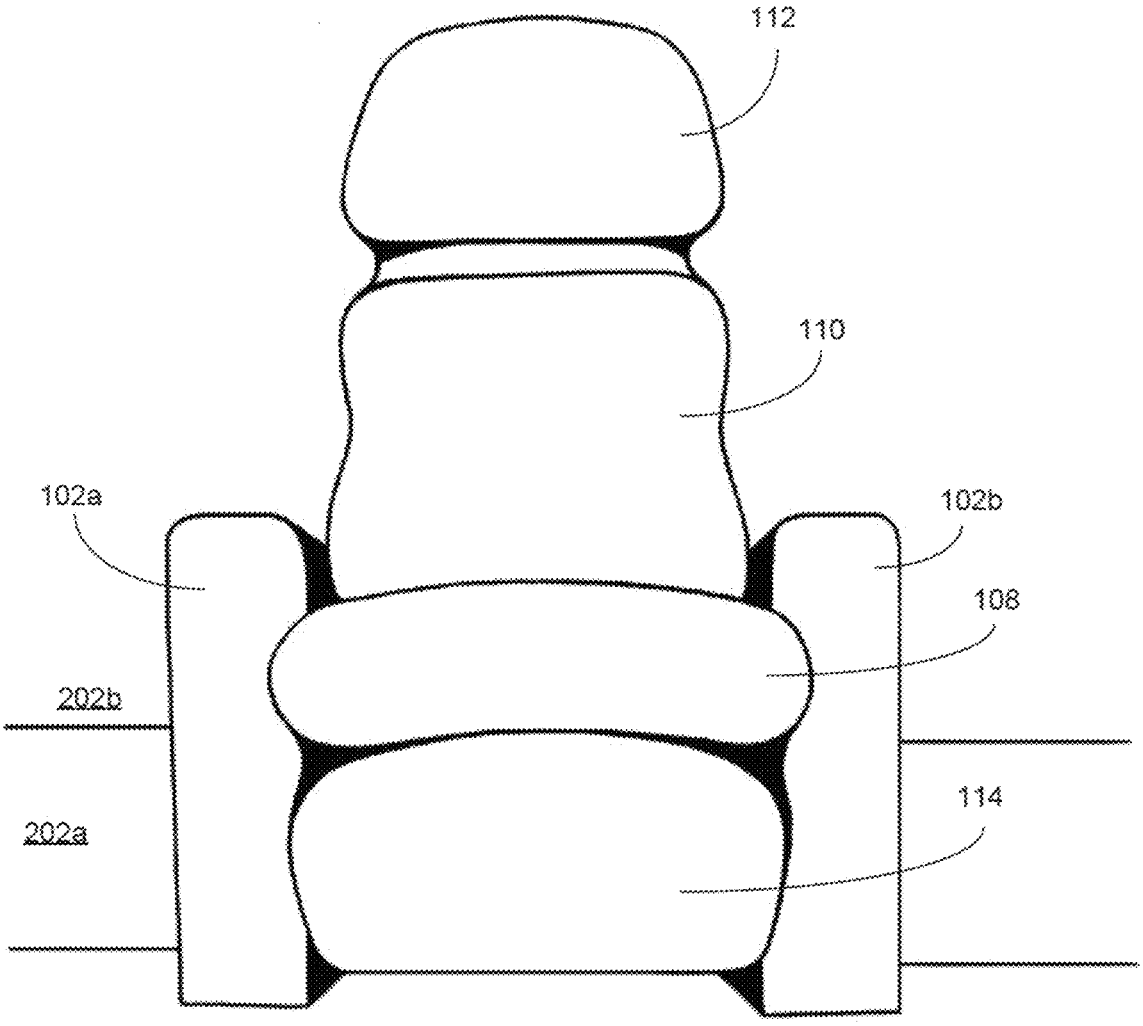
FIG. 3 illustrates a frontal view of the theater recliner assembly shown in FIG. 1, in accordance with an embodiment of the present invention.

As shown in FIG. 3, the recliner chair 101 further comprises a backrest 110 that functions in the same manner of a traditional cinema recliner. The backrest 110 is disposed adjacent to the seat cushion 108, so as to comfortably support the back of an occupant. The backrest 110 is configured to tilt rearwardly and forward in relation to the low profile seat cushion 108. In one alternative embodiment, a headrest 112 extends coplanar from the terminus of the backrest 110. In one non-limiting embodiment, the backrest 110 and headrest 112 comprise upholstered backs, including sculpted foam, such as polyurethane foam.

In some embodiments, the recliner chair 101 comprises an extendable footrest 114 disposed adjacent to the seat cushion 108. The footrest 114 is configured to extend and retract in relation to the vertical wall 202*a*. The footrest 114 conceals the vertical wall 202*a* of the riser 200 when retracted, and supports an occupant's feet when extended.

In operation, the backrest 110 tilts rearwardly, and the extendable footrest 114 extends when a rearward force is applied to the backrest 110. The rearward force can include an occupant pushing back on the backrest 110 while seated.

The tilted back position allows the occupant to sit at an angle while viewing an event at a theater.

Conversely, the backrest 110 tilts forward, and the extendable footrest 114 retracts when a forward force is applied to the backrest 110. The forward force can include the occupant leaning forward and applying a downward pressure on the footrest 114. The forward position allows the occupant to sit in an upright position while viewing an event at a theater. A motorized miniaturized lifting mechanism 116 is used to automate the raising and lowering of the footrest. This may include a small electric motor or an actuator that operates links in the miniaturized lifting mechanism 116.

Figure 2:
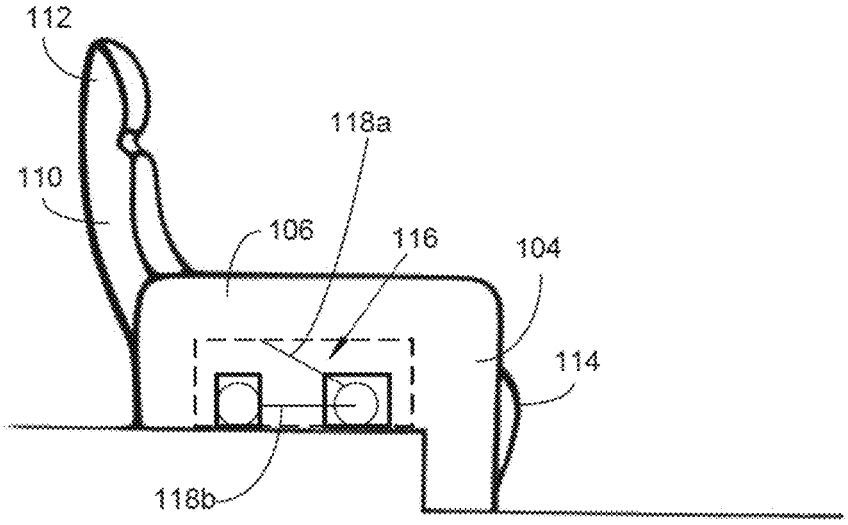
FIG. 2 illustrates a sectioned side view of the theater recliner assembly shown in FIG. 1, in accordance with an embodiment of the present invention.

As referenced in FIG. 2, the recliner chair 101 comprises a lifting mechanism 116 that is modified, e.g., displaced horizontally, or miniaturized, to fit and operate in a small space between the seat cushion 108 and the horizontal wall 202*b* of the riser 200. The miniaturized lifting mechanism 116 is being operatively connected to the backrest 110 and the extendable footrest 114.

The miniaturized lifting mechanism 116 provides a series of connected links and fulcrums 118*a*, 118*b* that articulate to facilitate tilting between the upright and reclined positions. In this manner, the miniaturized lifting mechanism 116 facilitates rearward and forward tilting by the backrest. The links and fulcrums 118*a*, 118*b* of the miniaturized lifting mechanism 116 further facilitate extension and retraction of the footrest. It is also significant to note that the low profile of the seat cushion provides operational space for the miniaturized lifting mechanism 116 to articulate in such a manner.

As discussed above, the assembly 100 provides a unique combination of L-shaped bases, low profile seat cushion, and miniaturized lifting mechanism that enable modular style detachably mounting to existing theater risers. These unique adaptations of a theater reclining chair minimize the need to construct new riser structures in a theater. The cost savings are significant. For example, the conversion of a typical theatre auditorium with stadium seating will cost the following:

50 seats*$600=$30,000

Construction Cost: $100,000

Total Cost: $130,000 per auditorium

Using the presently disclosed theater reclining chair, costs are dramatically reduced:

50 seats*$600=$30,000

Construction Cost: $20,000

Total Cost: $50,000 per auditorium

Consequently, the total cost of the theater recliner assembly 100 is about 40% of the traditional conversion method for theater chairs.

Figure 4:
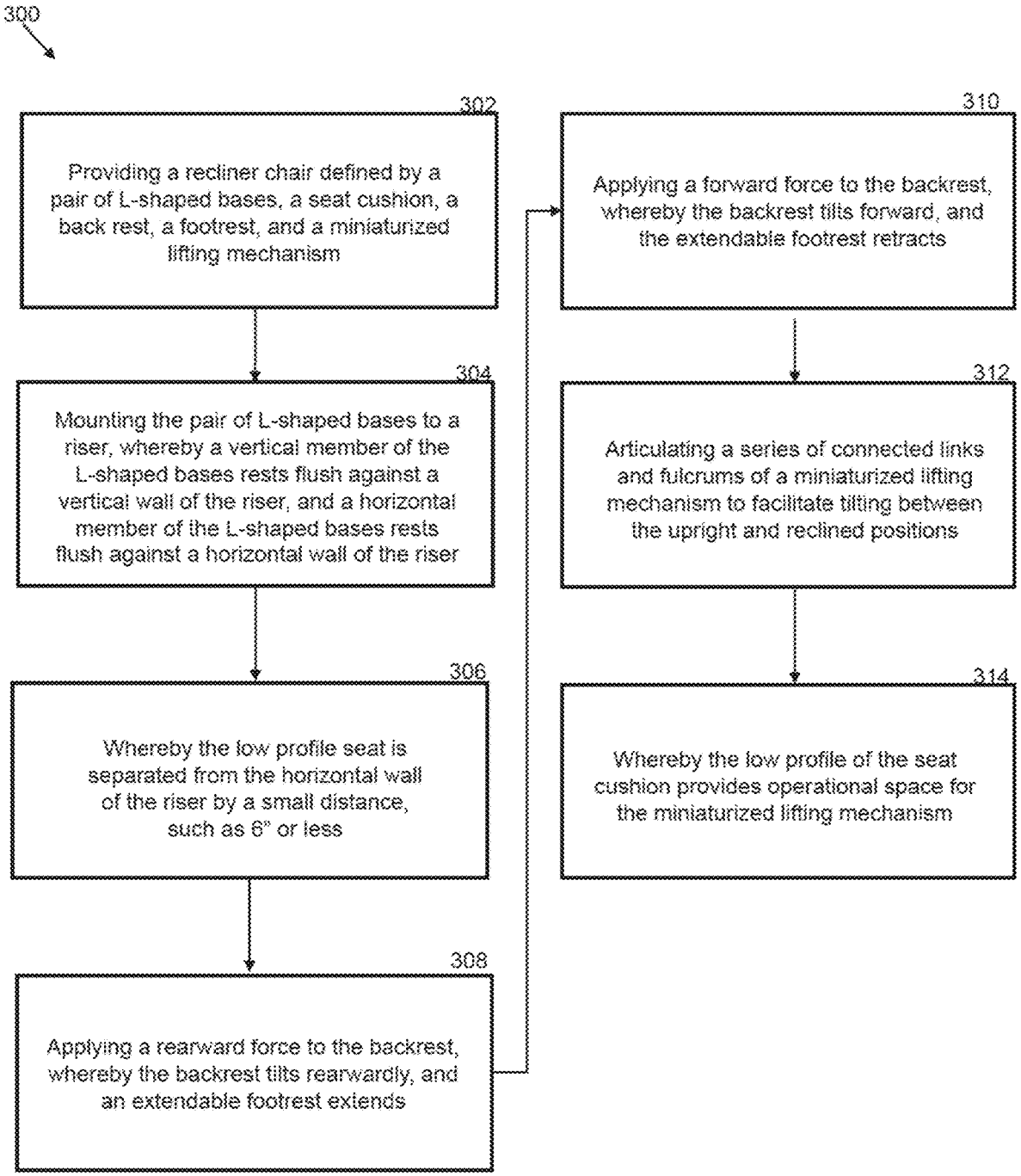
FIG. 4 illustrates a flowchart of an exemplary method for mounting recliners to existing theater risers, in accordance with an embodiment of the present invention.
Figure 5:
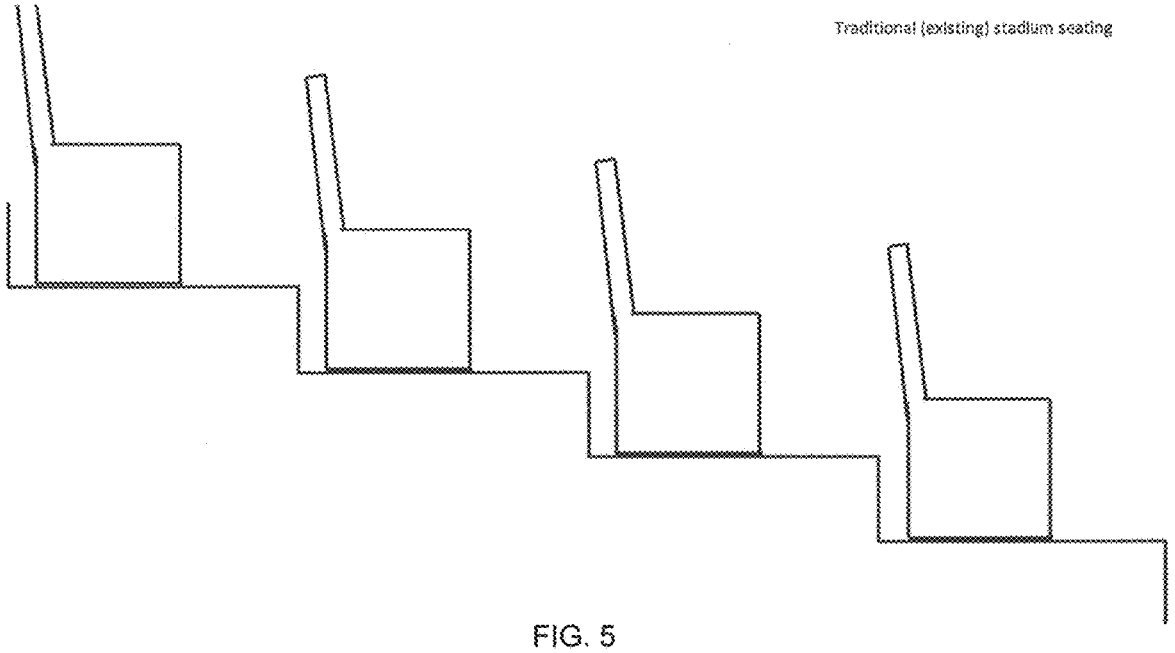
FIG. 5 is a schematic side elevational view of traditional (existing) stadium seating.
Figure 6:
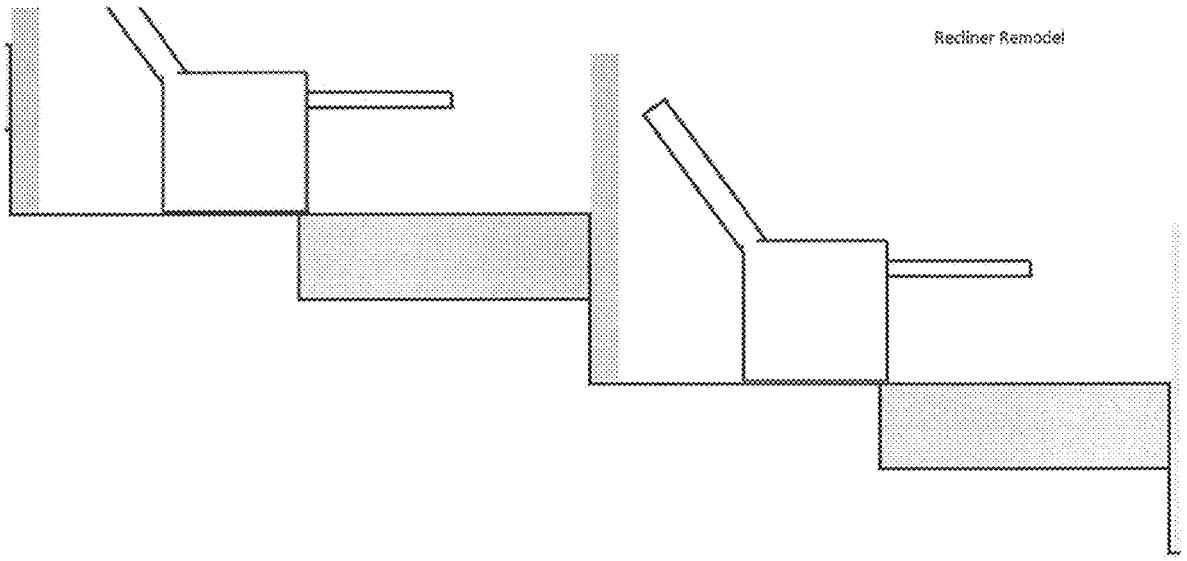
FIG. 6 is a schematic side elevational view of stadium seating using the recliner seating of FIG. 1.
Figure 7:
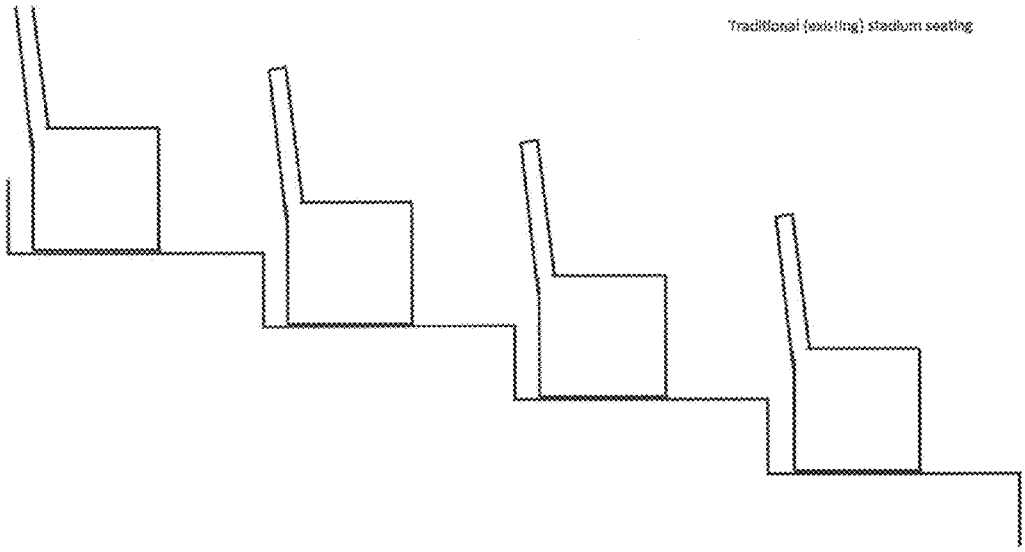
FIG. 7 is a schematic side elevational view of traditional (existing) stadium seating.
Figure 8:
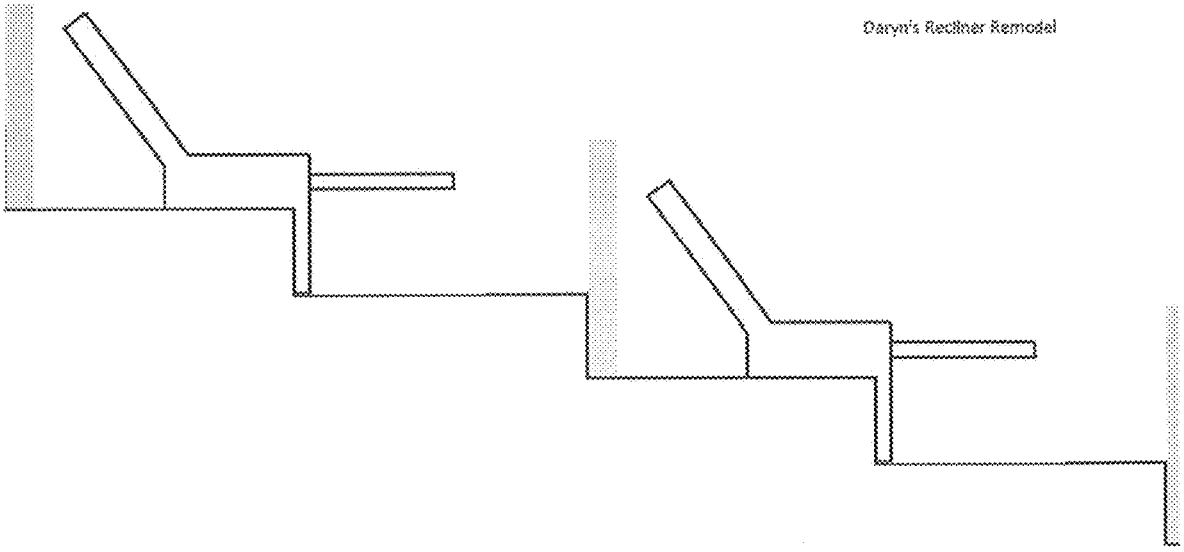
FIG. 8 is a schematic side elevational view of alternative stadium seating using the recliner seating of FIG. 1.

FIG. 4 illustrates a flowchart of an exemplary method 300 for mounting recliners to existing theater risers. The method 300 may include an initial Step 302 of providing a recliner chair defined by a pair of L-shaped bases, a seat cushion, a back rest, a footrest, and a miniaturized lifting mechanism. A Step 304 of mounting the pair of L-shaped bases to a riser, whereby a vertical member of the L-shaped bases rests flush against a vertical wall of the riser, and a horizontal member of the L-shaped bases rests flush against a horizontal wall of the riser.

The method 300 may further comprise a Step 306 includes whereby the low profile seat is separated from the horizontal wall of the riser by a small distance, such as 6" or less. In some embodiments, a Step 308 comprises applying a rearward force to the backrest, whereby the backrest tilts rearwardly, and an extendable footrest extends. A Step 310 includes applying a forward force to the backrest, whereby the backrest tilts forward, and the extendable footrest retracts. In some embodiments, a Step 312 may include articulating a series of connected links and fulcrums of a miniaturized lifting mechanism to facilitate tilting between the upright and reclined positions. A final Step 314 comprises whereby the low profile of the seat cushion provides operational space for the miniaturized lifting mechanism.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A theater recliner assembly, the assembly comprising:

a recliner chair having:

a pair of L-shaped bases defined by a vertical member and a horizontal member, the L-shaped bases being operable to detachably mount a riser defined by a vertical wall and a horizontal wall, whereby the vertical member of the L-shaped bases rests flush against the vertical wall of the riser, and the horizontal member of the L-shaped bases rests flush against the horizontal wall of the riser;

a low profile seat cushion being disposed parallel with the horizontal wall of the riser;

a backrest being disposed adjacent to the seat cushion, the backrest configured to tilt rearwardly and forward in relation to the low profile seat cushion;

an extendable footrest being disposed adjacent to the seat cushion, the extendable footrest being operable to conceal the vertical wall, the footrest configured to extend and retract in relation to the vertical wall;

whereby the backrest tilts rearwardly, and the extendable footrest extends when a rearward force is applied to the backrest, whereby the backrest tilts forward, and the extendable footrest retracts when a forward force is applied to the backrest; and a miniaturized lifting mechanism disposed between the seat cushion and the horizontal wall of the riser, the miniaturized lifting mechanism being operatively connected to the backrest and the extendable footrest, whereby the miniaturized lifting mechanism facilitates rearward and forward tilting by the backrest, whereby the miniaturized lifting mechanism facilitates extension and retraction of the footrest, whereby the low profile of the seat cushion provides operational space for the miniaturized lifting mechanism.

2. The assembly of claim 1, wherein the horizontal member of the L-shaped base is longer than the vertical member.

3. The assembly of claim 1, further comprising a headrest disposed coplanar with the backrest.

4. The assembly of claim 1, wherein the riser is a theater riser.

5. The assembly of claim 1, wherein the seat cushion is padded.

6. The assembly of claim 1, wherein the backrest is padded.

7. The assembly of claim 1, wherein the miniaturized lifting mechanism is motorized.

8. A method for mounting a theater recliner assembly to existing theater risers, the method comprising:

providing a recliner chair defined by a pair of L-shaped bases, a seat cushion, a back rest, a footrest, and a miniaturized lifting mechanism;

mounting the pair of L-shaped bases to a riser, whereby a vertical member of the L-shaped bases rests flush against a vertical wall of the riser, and a horizontal member of the L-shaped bases rests flush against a horizontal wall of the riser;

whereby the low profile seat is separated from the horizontal wall of the riser by a small distance;

applying a rearward force to the backrest, whereby the backrest tilts rearwardly, and an extendable footrest extends;

applying a forward force to the backrest, whereby the backrest tilts forward, and the extendable footrest retracts;

articulating a series of connected links and fulcrums of a miniaturized lifting mechanism to facilitate tilting between the upright and reclined positions; and whereby the low profile of the seat cushion provides operational space for the miniaturized lifting mechanism.

* * * * *